US006988714B2

(12) United States Patent
O'Neill

(10) Patent No.: US 6,988,714 B2
(45) Date of Patent: Jan. 24, 2006

(54) COVER LIFT MECHANISM

(75) Inventor: Edward L. O'Neill, Oakland, CA (US)

(73) Assignee: Lucasey Manufacturing Co., Oakland, CA (US)

( * ) Notice: Subject to any disclaimer, the term of this patent is extended or adjusted under 35 U.S.C. 154(b) by 52 days.

(21) Appl. No.: 10/818,543

(22) Filed: Apr. 5, 2004

(65) Prior Publication Data

US 2005/0224773 A1 Oct. 13, 2005

(51) Int. Cl.
*B66F 3/00* (2006.01)

(52) U.S. Cl. ..... 254/256; 254/261

(58) Field of Classification Search ..... 254/230, 254/243, 246, 251, 256, 260, 261
See application file for complete search history.

(56) References Cited

U.S. PATENT DOCUMENTS

| | | | | | |
|---|---|---|---|---|---|
| 543,290 | A | * | 7/1895 | Cardwell | 140/123.5 |
| 728,393 | A | * | 5/1903 | Hoagland | 254/230 |
| 740,630 | A | * | 10/1903 | Darst | 254/251 |
| 791,807 | A | * | 6/1905 | Mossman | 140/123.6 |
| 1,057,534 | A | * | 4/1913 | Ethridge | 254/251 |
| 1,488,180 | A | * | 3/1924 | Wallen | 254/246 |
| 2,221,277 | A | * | 11/1940 | Thompson | 254/251 |
| 5,588,342 | A | * | 12/1996 | Ahlgren et al. | 81/3.47 |

* cited by examiner

*Primary Examiner*—Emmanuel Marcelo
(74) *Attorney, Agent, or Firm*—Niro, Scavone, Haller & Niro

(57) ABSTRACT

A lift mechanism for use in raising ground trench covers includes an axially extending housing, a cam located at one end of the housing, and a latch located at the other end of the housing. Rotational cam movement drives movement of the latch between retracted and actuated positions. The cam is connected to a latch driving mechanism, which may include springs and/or cables of unequal strength and/or unequal length. A method for using the lift mechanism is also disclosed.

11 Claims, 1 Drawing Sheet

COVER LIFT MECHANISM

BACKGROUND OF THE INVENTION

The present invention relates to a lifting mechanism. More particularly, the invention relates to an adaptor or attachment used in combination with a cable or chain to lift relatively heavy plates used to cover trenches containing electrical power and/or data lines.

In recent years, many utilities have employed ground trenches for running electrical power and data lines. These trenches may be fabricated from steel, concrete, or composite materials and are intended to contain and protect the electrical lines, while affording ready access to them. Typically, each trench is covered by a series of plates which are placed end to end over the length of the trench and rest in recess running along the top edges of the trench sidewalls. Like the trenches, the cover plates may be fabricated from steel, concrete, or various composites and each may weigh as much as 50 to 100 pounds. The weight of the cover plates, alone, makes it difficult to place, remove and replace the plates when installing the trenches or servicing the electrical lines contained in them. In addition, sand or gravel may become lodged in the small spaces separating the individual plate segments or between the plate segments and trench walls, making removal of the covers even more difficult. When the covers are lodged or wedged in place due to a tight spacing between adjacent cover(s) and/or the lodging of sand or gravel, for example, the initial lifting force required to dislodge even a 50–100 pound cover may be as much as hundreds of pounds. In such an instance, the use of manual tools, such as crowbars or hand held lift hooks, has obvious limitations.

The present invention is directed to the problem of removing these ground trench cover plates.

SUMMARY OF THE INVENTION

The present invention overcomes disadvantages of prior cover lifting methods and mechanisms, while providing new advantages not previously obtainable. The present invention is directed to a lift mechanism for use in raising or moving trench covers, comprising an axially extending housing, a cam and a latch. The cam is located adjacent a first end of the housing and capable of moving between a first cam position and a second cam position. The latch is located adjacent a second end of the housing and is operatively associated with the cam and capable of rotational movement between a latch retracted position when the cam is in the first cam position and a latch actuated position when the cam is in the second cam position. The lift mechanism may be inserted into or removed from a cover aperture when the latch is in the latch retracted position, and the lift mechanism may engage and support the cover when the latch is in the latch actuated position.

In accordance with one preferred embodiment of the invention, the cam interacts with the latch through a pair of springs, one acting to urge the latch to its retracted position and the other to urge the latch to its actuated position. However, other cam and latch interaction mechanisms are contemplated.

In accordance with another preferred embodiment of the invention, the cam may move from its first position to its second position simply by applying a lifting force to the lift mechanism itself.

BRIEF DESCRIPTION OF THE DRAWINGS

The novel features which are characteristic of the invention are set forth in the appended claims. The invention itself, however, together with further objects and attendant advantages thereof, will be best understood by reference to the following description taken in connection with the accompanying drawings, in which:

DETAILED DESCRIPTION OF THE PREFERRED EMBODIMENTS

Set forth below is a description of what is currently believed to be the preferred embodiment and/or best example of the invention claimed. Alternatives or modifications to this preferred embodiment are contemplated. Any alternatives or modifications which make insubstantial changes in function, in purpose, in structure, or in result are intended to be covered by the claims of this patent.

Figure 1:
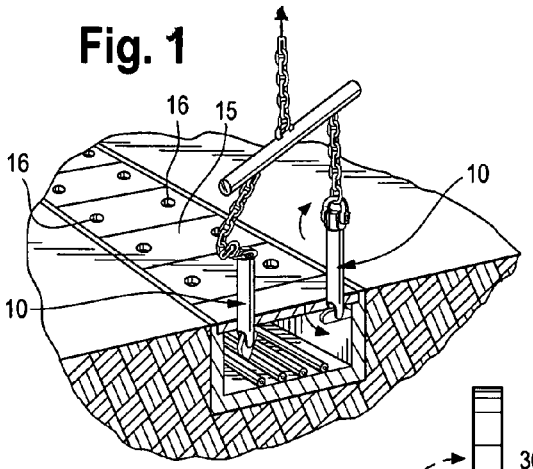
FIG. 1 is a perspective view, showing a cross-section of a typical ground trench with its overlying cover plates and illustrating the general use of the cover lift mechanism of the present invention.
Figure 2:
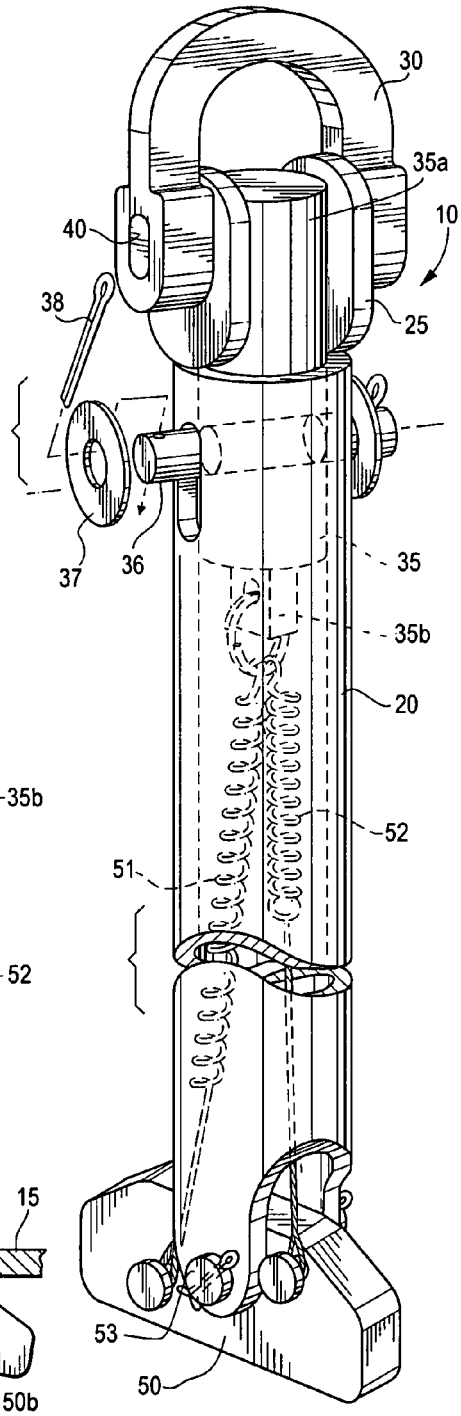
FIG. 2 is a perspective view illustrating various components of one preferred embodiment of the present invention.

Referring first to FIG. 1, cover lift mechanisms, each generally designated by reference numeral 10, may be engaged to a trench cover 15, for example, and lifted in tandem using a fork lift or other powered device to lift and remove the cover. As illustrated, each trench cover is typically provided with apertures 16 which receive lift mechanisms 10.

Figure 3:
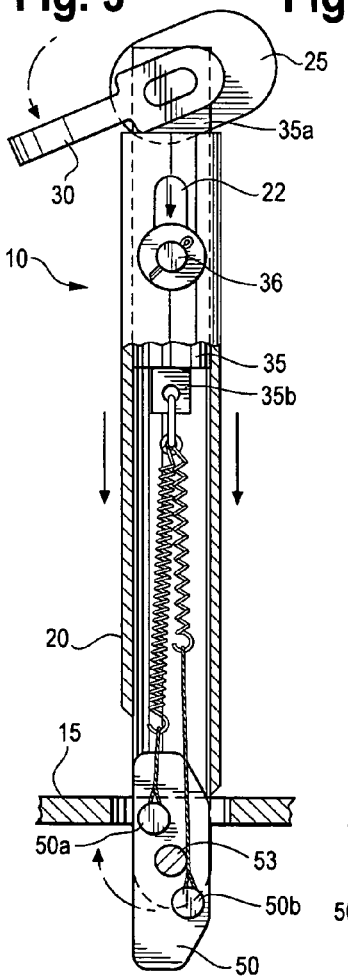
FIGS. 3 and 4 are side elevational views, in partial cross-section, illustrating the operation of the preferred embodiment shown in FIG. 2.
Figure 4:
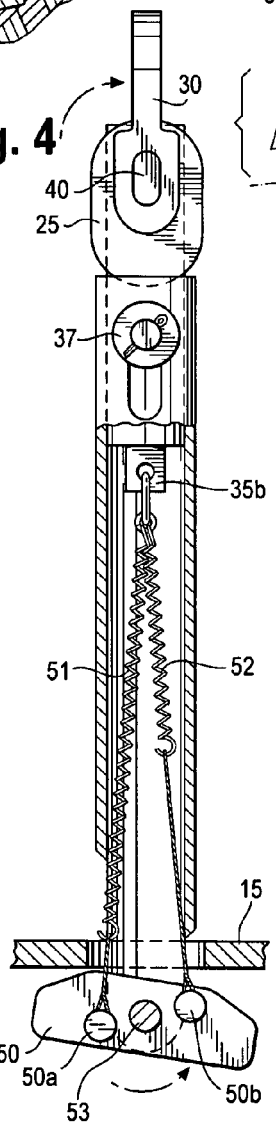

In the illustrated embodiment of the invention, the lift mechanism 10 includes a housing 20, a cam 25, a connector 30, an actuation piston 35, and latch 50 as major components. Housing 20 may be a cylindrical or have other cross-sectional shapes. Cam 25 is rotatably mounted relative to actuation piston 35, while connector 30 is rigidly connected to cam 25 by pin 40. Pin 40 may have an ovoid or other non-concentric, cross-sectional shape. Pin 40 also passes through the upper extension 35*a* of piston 35 allowing the pin 40, cam 25, and connector 30, to rotate relative to piston 35, as best shown in FIGS. 3–4. Assembly pin 36 is insertable through slot apertures 22 in housing 20, is fixed within actuation piston 35, and may be locked by a washer 37 and tie pin 38 connection as shown or by other means, securing the piston 35 in relative, movable position near a top portion of the housing 20. Pin 36 may move vertically along the axis of mechanism 10 ("axially") by sliding within slot 22, thus permitting slidable axial movement of piston 35 within housing 20. A lower portion 35*b* of actuation piston 35 is connected to latch 50 using various methods, as further described below.

In the example shown in the illustrated embodiments, piston 35 is connected to opposing portions of latch 50 about latch pivot point 53, at points 50*a*, 50*b*, by two extension springs having different spring rates. Spring 51 has a relatively low spring rate and is termed here a "latch retraction spring." Spring 52, has a relatively high spring rate and is termed here a "latch actuation spring." The specific spring dimensions and spring rates will depend upon the size and materials of the particular device and will be well known to or readily selected by those of ordinary skill in. Latch 50 is rotatable about latch pin 53 under the action of either of springs 51 and 52, as explained below.

The operation of the preferred embodiment of the cover lift mechanism 10, shown in the drawings, will now be described. When connector 30 and cam 25 are non-axially aligned with housing 20, or "unloaded" as shown in FIG. 3, latch 50 is in its axially-aligned or "retracted" position. This is due to the fact that latch retraction spring 51, the weaker spring, is actuated, while latch actuation spring 52 having a longer body length is not. Thus, spring 51 urges latch 50 to rotate about latch pin 53 in the clockwise direction of the arrow shown in FIG. 3, moving latch 50 into its retracted position. At this point, cover lift mechanism 10 may be inserted into or removed from the aperture 16 of cover plate 15.

To engage the latch, connector 30 and cam 25 (which may be of 2-piece or 1-piece construction) are brought into axial alignment with housing 20, that is "loaded," as shown in FIG. 4. Due to the geometry of cam 25, as it rotates pin 40 moves away from the upper end of housing 20 and piston 35 moves upwardly, as permitted by housing slot 22, tensioning spring 52. The spring rates and body lengths of the springs are selected such that now, given the raised position of piston 35, the latch actuation spring 52 applies a greater force to the latch, causing the latch to rotate in a counter-clockwise direction, as shown by the arrow in FIG. 4, to its open, actuated position. The weight of mechanism 10 is sufficient to counteract the force necessary to rotate cam 25 to move the latch into a retracted position. This permits connector 30 and cam 25 to be easily and manually moved into the loaded position.

Once the mechanism 10 has been inserted into the cover aperture 16 and latch 50 is oriented as illustrated in FIG. 4, the powered device joined to mechanism 10 via connector 30 may be operated to bring latch 50 into engagement with the underside of cover 15 and lift the cover off of the trench.

It should now be understood from the foregoing description that alternative mechanisms may be employed to connect the cam/piston arrangement to the latch. Such mechanisms include but are not limited to rack-and-pinion gears, elastic cables, chains, spring-and-cable, or spring-and-chain combinations, etc.

The above description is not intended to limit the meaning of the words used in the following claims that define the invention. Rather, it is contemplated that future modifications in structure, function, or result will exist that are not substantial changes and that all such insubstantial changes in what is claimed are intended to be covered by the claims.

I claim:

1. A lift mechanism for use in manipulating trench covers, comprising:

an axially extending housing;

a cam located adjacent a first end of the housing, the cam being capable of moving between a first cam position and a second cam position;

a latch located adjacent a second end of the housing, the latch being operatively associated with the cam and capable of rotational movement between a latch retracted position when the cam is in the first cam position and a latch actuated position when the cam is in the second cam position;

whereby the lift mechanism may be inserted into or removed from a cover aperture when the latch is in the latch retracted position, and the lift mechanism may engage and support the cover when the latch is in the latch actuated position; and wherein the housing at least partially encloses an actuation piston connected to the cam, the piston being capable of limited axial movement relative to the housing between first and second piston positions, whereby when in the first piston position the cam is in the first cam position and the latch is in the latch retracted position, and in the second piston position the cam is in the second cam position and the latch is in the latch actuated position.

2. The lift mechanism of claim 1, further comprising a latch retraction spring and a latch actuation spring, the springs connecting the piston to the latch and having different spring rates, wherein the latch retraction spring controls the position of the latch when the cam is in the first cam position and the latch actuation spring controls the position of the latch when the cam is in the second cam position.

3. The lift mechanism of claim 2, wherein the springs have different body lengths.

4. The lift mechanism of claim 2, wherein the piston is connected to the latch by a combination of springs and cables.

5. The lift mechanism of claim 1, wherein in the second cam position the cam is axially aligned with the housing.

6. The lift mechanism of claim 1, further comprising a connector associated with the cam, facilitating linking of the mechanism to a device for generating a force on the connector sufficient to remove the cover.

7. A lift mechanism for use in raising trench covers, comprising:

an axially extending housing;

a cam located adjacent a first end of the housing, the cam being connected to the actuation piston and capable of moving between a first cam position and a second cam position;

a latch located adjacent a second end of the housing, the latch being operative associated with the cam and capable of rotational movement between a latch retracted position when the cam is in the first cam position, and a latch actuated position when the cam is in the second cam position; and latch driving linkage connecting the cam to the latch;

whereby the lift mechanism may be inserted into or removed from a cover aperture when the latch is in the latch retracted position, and the lift mechanism may engage and support the cover when the latch is in the latch actuated position.

8. The lift mechanism of claim 7, wherein the latch driving linkage includes an actuation piston at least partially enclosed by the housing and connected to the cam, the piston being capable of limited axial movement relative to the housing.

9. The lift mechanism of claim 7, wherein the latch driving linkage includes two springs of having different spring rates.

10. A method for using a lift mechanism to raise ground trench covers, comprising the steps of:

positioning an axially extending housing over an aperture of a cover to be raised;

causing a cam located adjacent a first end of the housing to be placed in a first cam position, resulting in a latch located at a second end of the housing to be placed in a latch retracted position in which the latch is substantially axially aligned with the housing;

inserting the latch within the aperture of the cover;

causing the cam to be placed in a second position cam, resulting in the latch to be placed in a latch actuated position in which the latch is substantially out of axial alignment with the housing; and raising the cover by generating a lifting a force on the mechanism.

11. The method for using the lift mechanism of claim 10, wherein the first cam position is one in which the cam is not in axial alignment with the housing and the second cam position is one in which the cam is in substantial axial alignment with the housing.

* * * * *